US006863748B2

(12) United States Patent
Zervoudis et al.

(10) Patent No.: US 6,863,748 B2
(45) Date of Patent: Mar. 8, 2005

(54) PROCESS AND ALLOY FOR DECORATIVE GALVANIZING OF STEEL

(75) Inventors: John Zervoudis, Kilbride (CA); Victor M. Duarte, Hamilton (CA); Graham W. Poag, Grimsby (CA)

(73) Assignee: Teck Cominco Metals Ltd., Vancouver (CA)

( * ) Notice: Subject to any disclaimer, the term of this patent is extended or adjusted under 35 U.S.C. 154(b) by 233 days.

(21) Appl. No.: 10/328,036

(22) Filed: Dec. 26, 2002

(65) Prior Publication Data

US 2003/0124380 A1 Jul. 3, 2003

Related U.S. Application Data

(62) Division of application No. 09/688,115, filed on Oct. 16, 2000, now Pat. No. 6,569,268.

(51) Int. Cl.[7] ..... C23C 2/06; C22C 18/00

(52) U.S. Cl. ..... 148/441; 420/514; 420/520; 428/658; 428/659

(58) Field of Search ..... 148/441; 420/514, 420/520; 428/658, 659

(56) References Cited

U.S. PATENT DOCUMENTS 6,187,116 B1 * 2/2001 Gilles ..... 148/441
6,280,795 B1 * 8/2001 Zervoudis et al. ..... 427/433

FOREIGN PATENT DOCUMENTS

WO 98/55664 * 12/1998

* cited by examiner

*Primary Examiner*—Sikyin Ip
(74) *Attorney, Agent, or Firm*—Arne I. Fors

(57) ABSTRACT

A process and an alloy for galvanizing non-reactive steel and mixed or moderately reactive steel for providing a decorative spangle to the galvanized coating. The alloy contains 0.1 to less than 0.8 wt % tin, 0.05 to 0.2 wt % bismuth, 0.001 to 0.008 wt % aluminum, and optionally 0 to 0.1 wt % nickel, the balance zinc of commercial purity.

9 Claims, 11 Drawing Sheets

PROCESS AND ALLOY FOR DECORATIVE GALVANIZING OF STEEL

This application is a Divisional of Application Ser. No. 09/688,115 filed Oct. 16, 2000, now U.S. Pat. No. 6,569, 268.

BACKGROUND OF THE INVENTION (i) Field of the Invention

This invention relates to a galvanizing alloy and process and, more particularly, relates to a galvanizing alloy and an immersion galvanizing process for providing a decorative coating to non-reactive and to moderately reactive or mixed reactive steels.

(ii) Description of the Related Art

It is necessary, in the manufacture of low-alloy high-strength steels by the continuous casting process, to add elements that 'kill' or deoxidize the steel i.e. prevent gaseous products which produce porosity. Silicon is commonly employed for this purpose. These steels, as a result, generally contain between 0.01% to 0.3%, by weight, silicon but may include up to or more than about 0.5 wt % silicon and are known as 'reactive steels' or silicon steels.

Phosphorus in the steel also affects reactivity having an accepted measure of reactivity that is approximately 2.5 times that of silicon. Thus, the silicon content plus 2.5 times the phosphorus content is known as the effective silicon content of the steel.

Steels with silicon levels between 0.05 to 0.15 (i.e. around the first "Sandelin Peak" area), may also develop a 'mixed' reactivity coating. This coating is characterized by a combination of reactive and non-reactive areas on the same steel which is believed to be due to differences in localized silicon levels on the surface of the steel.

Silicon steels that have high reactivity pose problems to the galvanizing process, producing thick, brittle and uneven coatings, poor adherence and/or a dull or marbled appearance. These coatings are known as 'reactive' coatings. The high reactivity of the silicon steels also causes excessive zinc consumption and excessive dross formation.

Silicon released from the steel during galvanizing is insoluble in the intermetallic layer known as the zeta layer. This creates an instability in the zeta layer and produces thick, porous intermetallic layers. The microstructure is characterized by a very thin and uneven delta layer overlaid by a very thick and porous zeta layer. The porous intermetallic layer allows liquid bath metal to react near the steel interface during the entire immersion period. The result is a linear growth mode with immersion time that allows the formation of excessively thick coatings. These coatings are generally very rough, undesirably thick, brittle and dull in appearance.

It is known to control steel reactivity by adding alloying elements to the zinc galvanizing bath. One such addition is nickel in a process known as the Technigalva™ (or Nickel-Zinc) process. A nickel content of about 0.05 to 0.10% by weight in the zinc bath effectively controls reactive steels having up to about 0.25% by weight silicon content. For steels having silicon levels above approximately 0.25 wt %, this nickel-zinc process is not effective and thus it is only a partial solution to the reactive steel galvanizing problem. Low reactivity (normal) steels, when galvanized by the nickel-zinc process, pose the same difficulty as seen in low temperature galvanizing in that coating thickness may be unacceptably thin. With this process, it is thus preferred that the galvanizer know the reactivity of the steel beforehand and adjust galvanizing conditions accordingly, both of which are difficult to accomplish in practice. Under some conditions, this process also produces dross that tends to float in the bath and be drawn out on the workpiece, producing unacceptable coatings.

Another alloy used to control reactivity is that disclosed in French Patent No. 2,366,376, granted Oct. 27, 1980, for galvanizing reactive steels, known as the Polygalva™ process. The alloy comprises zinc of commercial purity containing by weight 0.1 to 1.5% lead, 0.01 to 0.05% aluminum, 0.03 to 2.0% tin, and 0.001 to 2.0% magnesium.

U.S. Pat. No. 4,439,397, granted Mar. 27, 1984, discusses the accelerated rate at which the magnesium and aluminum are consumed or lost in this Polygalva™ process for galvanizing steel. Procedures are presented to overcome the inherent difficulty in replenishing deficient aluminum or magnesium in the zinc alloy galvanizing bath. The process has serious limitations in that the steel has to be meticulously degreased, pickled, pre-fluxed and oven-dried to obtain good quality product free of bare spots. Thus, in most cases, new high-quality installations are usually required.

U.S. Pat. No. 4,168,972, issued Sep. 25, 1979, and U.S. Pat. No. 4,238,532, issued Dec. 9, 1980, also disclose alloys for galvanizing reactive steels. The alloys presented include variations of the Polygalva™ alloy components of lead, aluminum, magnesium and tin in zinc.

It is known in the prior art that aluminum included in the galvanizing bath reduces the reactivity of the high silicon steels. A process known as the Supergalva™ process includes an alloy of zinc containing 5 wt % aluminum. The process requires a special flux and double dipping not generally accepted by commercial galvanizers.

Co-Pending U.S. patent application Ser. No. 08/667,830 filed Jun. 20, 1996, describes a new alloy and process for controlling reactivity in steels with silicon content up to 1 wt %. The alloy comprises zinc of commercial purity containing, by weight, one or both of vanadium in the amounts of at least 0.02% to 0.04% and titanium in the amounts of at least 0.02% to 0.05%.

Co-pending U.S. patent application Ser. No. 09/445,144 filed Feb. 22, 2000, describes a new alloy and process for controlling reactivity in steels in silicon contents up to 1 wt % in which the alloy comprises, by weight, aluminum in the amount of at least 0.001%, tin in the amount of at least 0.5% to a maximum of 2%, preferably at least 0.8%, and one of an element selected from the group consisting of vanadium in the amount of at least 0.02%, preferably 0.05% to 0.12%, titanium in the amount of at least 0.03%, preferably 0.06% to 0.10%, and both vanadium and titanium together in the amount of at least 0.02% vanadium and at least 0.01% titanium for a total of at least 0.03%, preferably 0.05 wt % to 0.15%, of vanadium and titanium, the balance zinc.

PCT Application No. PCT/BE98/00075 discloses a zinc alloy for galvanizing reactive steel comprising 1 to 5 wt % tin+bismuth, 0 to saturation of lead, 0.025 to 0.2 wt % of at least one of nickel, chromium or manganese, 0 to 0.03 wt % of at least one of aluminum, calcium and magnesium, the balance zinc. PCT Application No. PCT/EP97/00864 discloses a zinc alloy for galvanizing reactive steel comprising either 3 to 15 wt % tin or 1 to 5 wt % tin and 0.01 to 0.1 wt % nickel, lead up to saturation, and 0.06 wt % of at least one of aluminum, calcium and magnesium, the balance zinc.

The above prior art is directed at highly reactive steels. The tin contents of these alloy baths is high and, in that tin and bismuth are relatively expensive metals, it is economically desirable to provide an alloy for decorative galvanized coatings for non-reactive and mixed and moderately reactive steels having reduced amounts of tin and bismuth.

It is known in the prior art to produce coloured zinc coatings on metal and non-metallic surfaces. U.S. Pat. No. 3,530,013, issued Sep. 22, 1970, discloses a galvanizing zinc coating having minor amounts of an oxygen-avid element such as titanium, manganese or vanadium which is oxidized under controlled time and temperature conditions for provision of a surface film of an oxide of the oxygen-avid element having light interference colour characteristics.

SUMMARY OF THE INVENTION

It is a principal object of the present invention therefore to provide a process and an inexpensive alloy for galvanizing non-reactive and mixed or moderately reactive steels to enhance drainage and fluidity of the galvanizing coating while producing decorative coating.

In its broad aspect, the process of the invention for galvanizing steel containing up to 0.25 wt % silicon comprises immersing the steel in a molten bath of an alloy consisting essentially of 0.1 to less than 0.8 wt % tin, 0.05 to 0.2 wt % bismuth, 0.001 to 0.008 wt % aluminum and 0 to 0.10 wt % nickel, the balance zinc of commercial purity. The steel preferably is immersed in the molten bath for about 2 to 20 minutes at a bath temperature in the range of about 440 to 460° C.

For non-reactive steel, the zinc alloy preferably consists essentially of 0.4 to less than 0.8 wt % tin, 0.05 to 0.15 wt % bismuth and 0.001 to 0.005 wt % aluminum, more preferably about 0.5 wt % tin, about 0.1 wt % bismuth and about 0.003 to 0.005 wt % aluminum, the balance zinc of commercial purity.

For mixed or moderately reactive steel, the zinc alloy preferably consists essentially of 0.4 to less than 0.8 wt % tin, 0.05 to 0.15 wt % bismuth, 0.001 to 0.005 wt % aluminum and 0.04 to 0.09 wt % nickel, more preferably about 0.5 wt % tin, about 0.1 wt % bismuth, about 0.003 to 0.005 wt % aluminum, and about 0.04 to 0.06 wt % nickel, the balance zinc of commercial purity.

The non-reactive steel of the invention has a zinc alloy coating with a decorative spangle consisting essentially of 0.1 to less than 0.8 wt % tin, 0.05 to 0.2 wt % bismuth, 0.001 to 0.008 wt % aluminum and 0 to 0.10 wt % nickel, the balance zinc of commercial purity.

The mixed or moderately reactive steel of the invention containing up to 0.25 wt % silicon has a zinc alloy coating with a decorative spangle consisting essentially of 0.1 to less than 0.8 wt % tin, 0.05 to 0.2 wt % bismuth, 0.001 to 0.008 wt % aluminum and 0.04 to 0.10 wt % nickel, the balance zinc of commercial purity.

BRIEF DESCRIPTION OF THE DRAWINGS

The process and alloys of the invention will be described with reference to the accompanying drawings, in which.

DESCRIPTION OF THE PREFERRED EMBODIMENT

Figure 1:
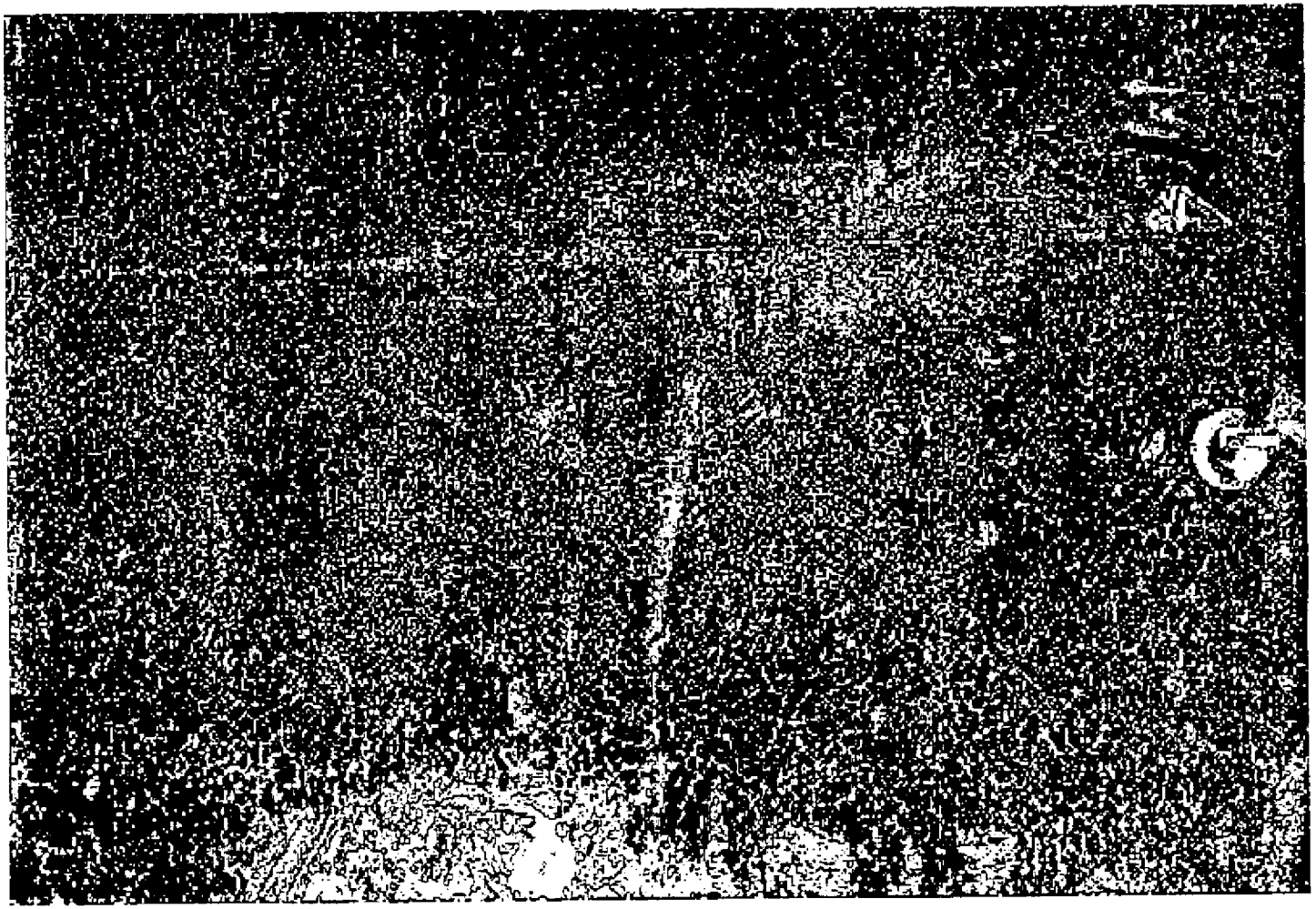
FIG. 1 is a photograph of a hot-dipped galvanized steel sample according to Test No. 1.

The process and the alloy of the invention for hot-dip galvanizing of non-reactive steel and for mixed or moderately reactive steel having up to 0.25 wt % silicon produces decorative coatings having a distinctive spangle and brightness to enhance the appearance of galvanized steel. The alloy will not produce a spangled, bright coating on highly reactive steels having a silicon level in excess of 0.25 wt %. The alloy is produced by adding low amounts of tin, bismuth and aluminum, and optionally nickel, to a molten zinc bath at a conventional bath temperature in the range of about 440 to 460° C.

The alloying metals are added by the introduction of a master alloy bar having effective amounts of the tin, bismuth and aluminum, and optionally nickel, to a molten zinc bath to produce a galvanizing bath containing 0.1 to less than 0.8 wt % tin, 0.05 to 0.2 wt % bismuth, 0.001 to 0.008 wt % aluminum and 0 to 0.1 wt % nickel. For non-reactive steel, the preferred composition comprises 0.4 to less than 0.8 wt % tin, 0.05 to 0.15 wt % bismuth and 0.001 to 0.005 wt % aluminum, more preferably about 0.5 wt % tin, about 0.1 wt % bismuth and about 0.003 to 0.005 wt % aluminum, the balance zinc of commercial purity. For mixed or moderately reactive steel, the zinc alloy preferably comprises 0.4 to less than 0.8 wt % tin, 0.05 to 0.15 wt % bismuth, 0.001 to 0.005 wt % aluminum and 0.04 to 0.09 wt % nickel, more preferably about 0.5 wt % tin, about 0.1 wt % bismuth, about 0.003 to 0.005 wt % aluminum, and about 0.04 to 0.06 wt % nickel, the balance zinc of commercial purity.

Although tin at levels of above 0.8 wt % produced a decorative coating, it was found surprisingly that bright decorative galvanized coatings with a finely-grained spangle can be produced economically with tin contents of less than 0.8 wt %. More importantly, it was found that the combination of relatively low amounts of tin at less than 0.8 wt % with relatively low amounts of bismuth at less than 0.2 wt % produced a synergistic effect resulting in large dendritic or feather-like spangles. Aluminum is added as a brightener and the preferred range is about 0.003 to 0.005 wt % for both non-reactive and mixed or moderately reactive steels.

The zinc of "commercial purity" referred to herein will be understood to include conventional Prime Western (PW) zinc, which contains up to 1.3 wt % lead, typically about 1.0 wt % lead, and Special High Grade (SHG) zinc.

The process and galvanizing alloys of the invention will be described with reference to the following non-limitative examples.

Galvanizing baths were prepared by the introduction of tin, bismuth, aluminum and optionally nickel to molten SHG zinc and PW zinc for the 24 immersion tests conducted on moderately reactive steel (ASTM A36) as indicated in Table I. The bath was maintained at 450° C. and steel coupons were immersed for two minutes.

TABLE I

| Bath | Test # | Elements Added, % Wt. Sn | Bi | Al | Ni |
|---|---|---|---|---|---|
| Zn (SHG) | 1 | 0 | 0 | 0.003 | 0 |
| | 2 | 0.1 | 0 | 0.003 | 0 |
| | 3 | 0.5 | 0 | 0.003 | 0 |
| | 4 | 1.0 | 0 | 0.003 | 0 |
| | 5 | 0 | 0.05 | 0.003 | 0 |
| | 6 | 0 | 0.10 | 0.003 | 0 |
| | 7 | 0 | 0.20 | 0.003 | 0 |
| | 8 | 0 | 0.50 | 0.003 | 0 |
| | 9 | 0.1 | 0.05 | 0.003 | 0 |
| | 10 | 0.1 | 0.1 | 0.003 | 0 |
| | 11 | 0.5 | 0.1 | 0.003 | 0 |
| | 12 | 0.5 | 0.2 | 0.003 | 0 |
| | 13 | 0.8 | 0.2 | 0.003 | 0 |
| Zn—Pb | 14 | 0 | 0 | 0.003 | 0 |
| | 15 | 0.1 | 0.1 | 0.003 | 0 |
| | 16 | 0.5 | 0.1 | 0.003 | 0 |
| | 17 | 0.8 | 0.1 | 0.003 | 0 |
| | 18 | 0.8 | 0.2 | 0.003 | 0 |
| Zn (SHG) | 19 | 0 | 0 | 0.003 | 0.05 |
| | 20 | 0.5 | 0.1 | 0.003 | 0.05 |
| | 21 | 0.5 | 0.1 | 0.003 | 0.09 |
| Zn—Pb (PW) | 22 | 0 | 0 | 0.003 | 0.05 |
| | 23 | 0.5 | 0.1 | 0.003 | 0.05 |
| | 24 | 0.5 | 0.1 | 0.003 | 0.09 |

The results of the tests are as follows;

Test No. 1

A steel sample was dipped in a Zn (SHG) bath containing 30 ppm Al as a coating brightner. The typical coating appearance produce on the steel was devoid of any dicernable spange, as typified in FIG. 1.

Test Nos. 2–4

Figure 2:
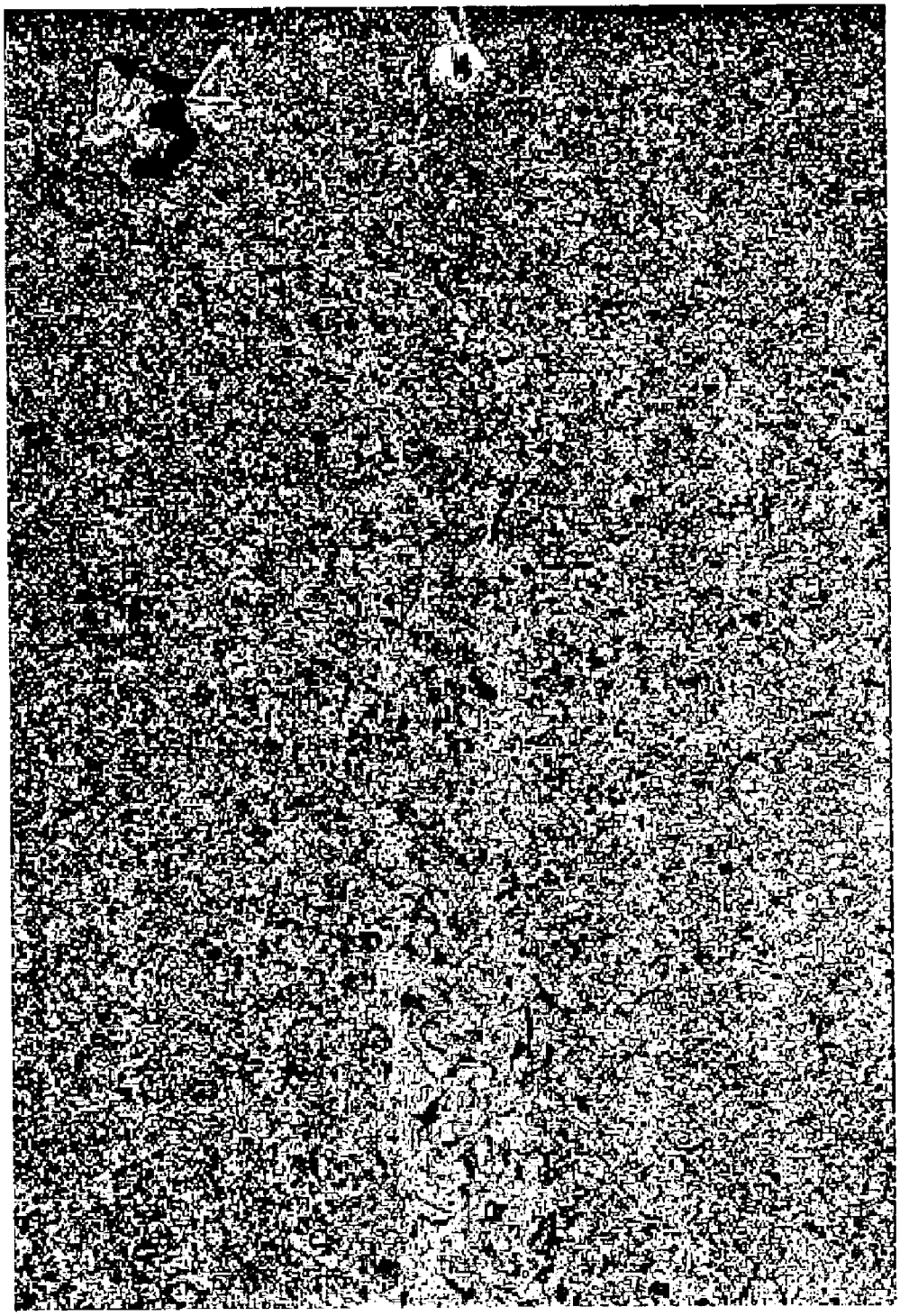
FIG. 2 is a photograph of a hot-dipped galvanized steel sample according to Test No. 3.

Steel samples were dipped in Zn baths with 30 ppm Al to which amounts of 0.1%, 0.5%, and 1% Sn were added. The typical coating appearence produced on the galvanized steel samples showed a very fine, equixed grain or spangle, which increased progressively from less than ⅛ in. to about ¼ in. as the amount of Sn addition increased from 0.1%, respectively, as shown in FIG. 2 for Test No. 3. At a level of 0.5% Sn the spangles were a mixture of very shiny reflective grains and dull or froaty grains, giving a distinctive decorative appearance to the galvaized coating.

Test Nos. 5–8

Figure 3:
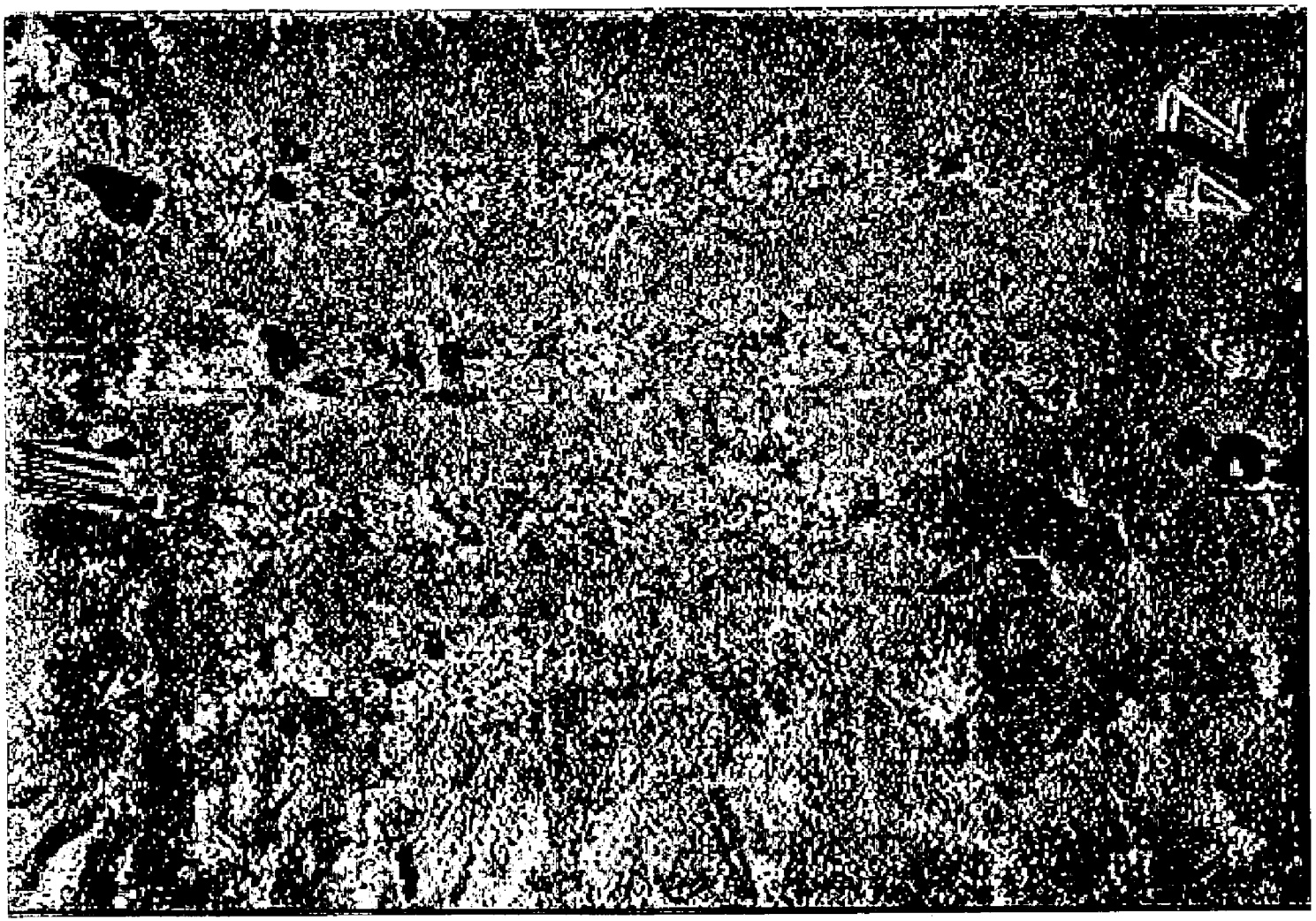
FIG. 3 is a photograph of a hot-dipped galvanized steel sample according to Test No. 7.

Steel samples were dipped in Zn baths with 30 ppm Al to which amounts of 0.05%, 0.1%, 0.2% and 0.5% Bi were added. The galvaized coatings produced had a faintly visible equixed spangle of about ¼ in. to ½ in., which did not vary significantly between the 0.05, 0.1 and 0.2 Bi additions. FIG. 3 shows the coating appearance of Test No. 7 containing 0.2 wt % bismuth addition. The 0.5 Bi addition produced a large dendritic spangle, with long columnar grains of ¾ in. to more than 2 in. in length.

Test Nos. 9–13

Figure 4:
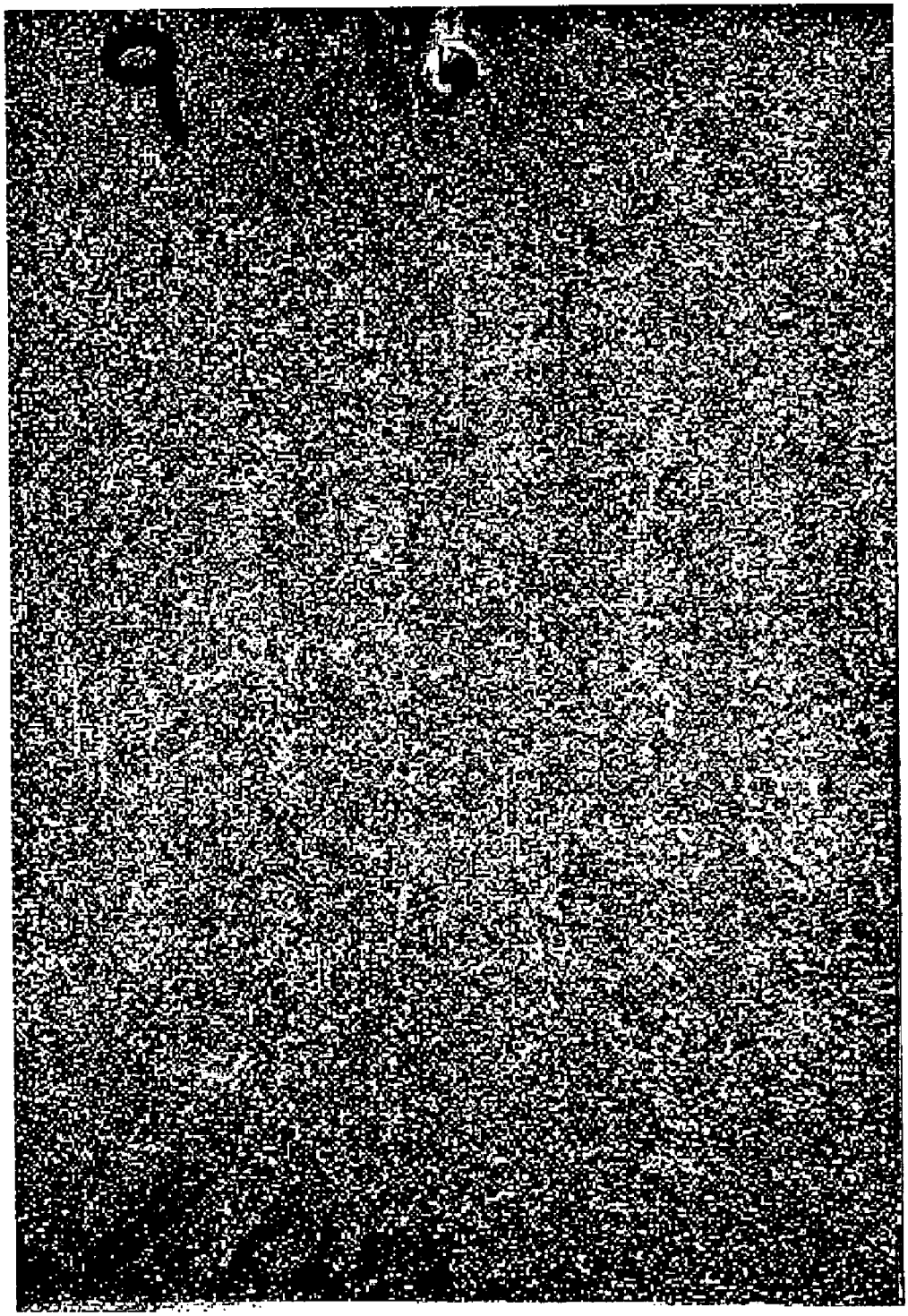
FIG. 4 is a photograph of a hot-dipped galvanized steel sample according to Test No. 9.
Figure 5:
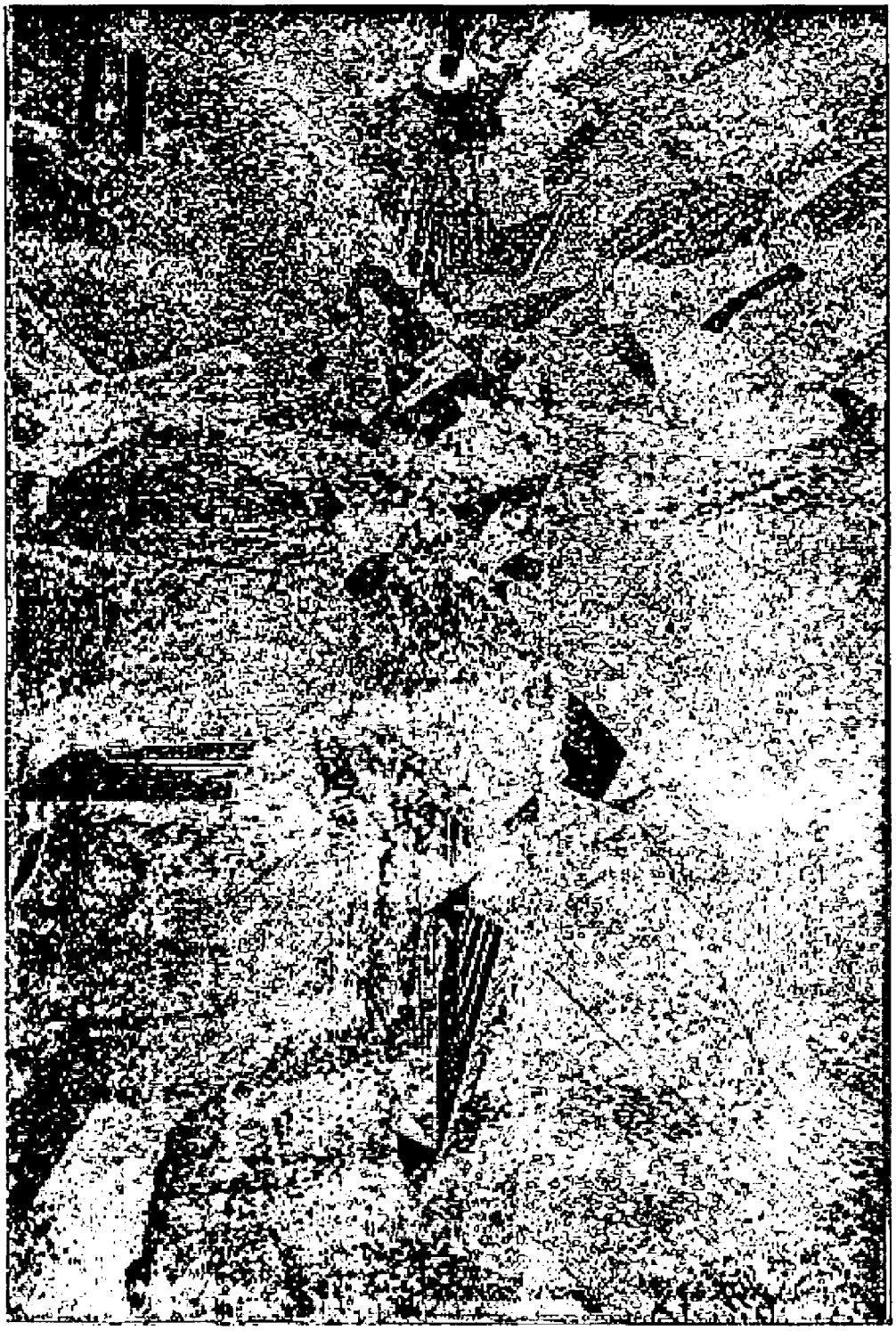
FIG. 5 is a photograph of a hot-dipped galvanized steel sample according to Test Nos. 11.

Steel samples were dipped in Zn baths with 30 ppm Al to which both Sn and Bi were added, in amounts of 0.1 Sn and 0.05 Bi, 0.1 Sn and 0.1 Bi, 0.5 Sn and 0.1 Bi, 0.5 and 0.2 Bi and, 0.8 Sn and 0.2 Bi, respectively. Test 9 produced a satin-like coating appearance with a very faint, non-distinctive spangle, as shown in FIG. 4. Test 10 produced a visible spangle of ¼ in. to 1 in., which contained some columnar dendrites at the outer edges of the sample. Test 11, 12 and 13 produced very distinctive feather-like, dendritic spangles that varied in reflectivity from mirror like shiny to frosty or hazy, giving a decorative appearance to the galvanized coating. Spangle sized varied from ¼ in. to as much as 2 in., becoming more equixed on bath 13. Since there is not a very significant difference between the spangles, bath 11 containing 0.5 Sn and 0.1 Bi is the preferred composition that produces the desired decorative coating appearance with the least amount of Sn+Bi, an example of which is shown in FIG. 5.

Test No. 14

Figure 6:
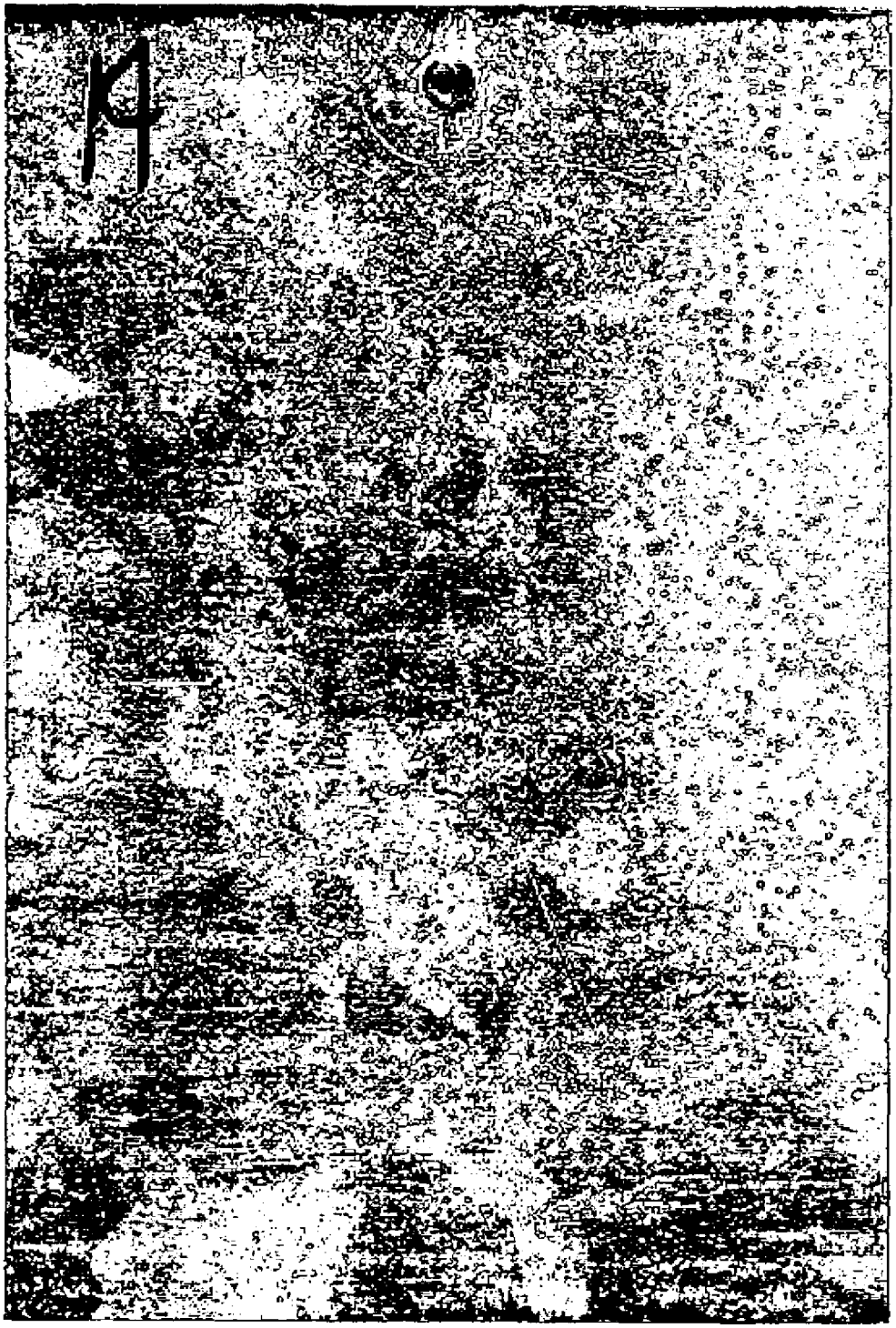
FIG. 6 is a photograph of a hot-dipped galvanized steel sample according to Test No. 14.

A steel sample was dipped in a bath of Zn+Pb (PW zinc) with 30 ppm Al aditions. The leaded zinc coating had a very faint spangle that was not readily visible and was masked by the coating surface oxide layer, as shown in FIG. 6.

Test Nos. 15 to 18

Figure 7:
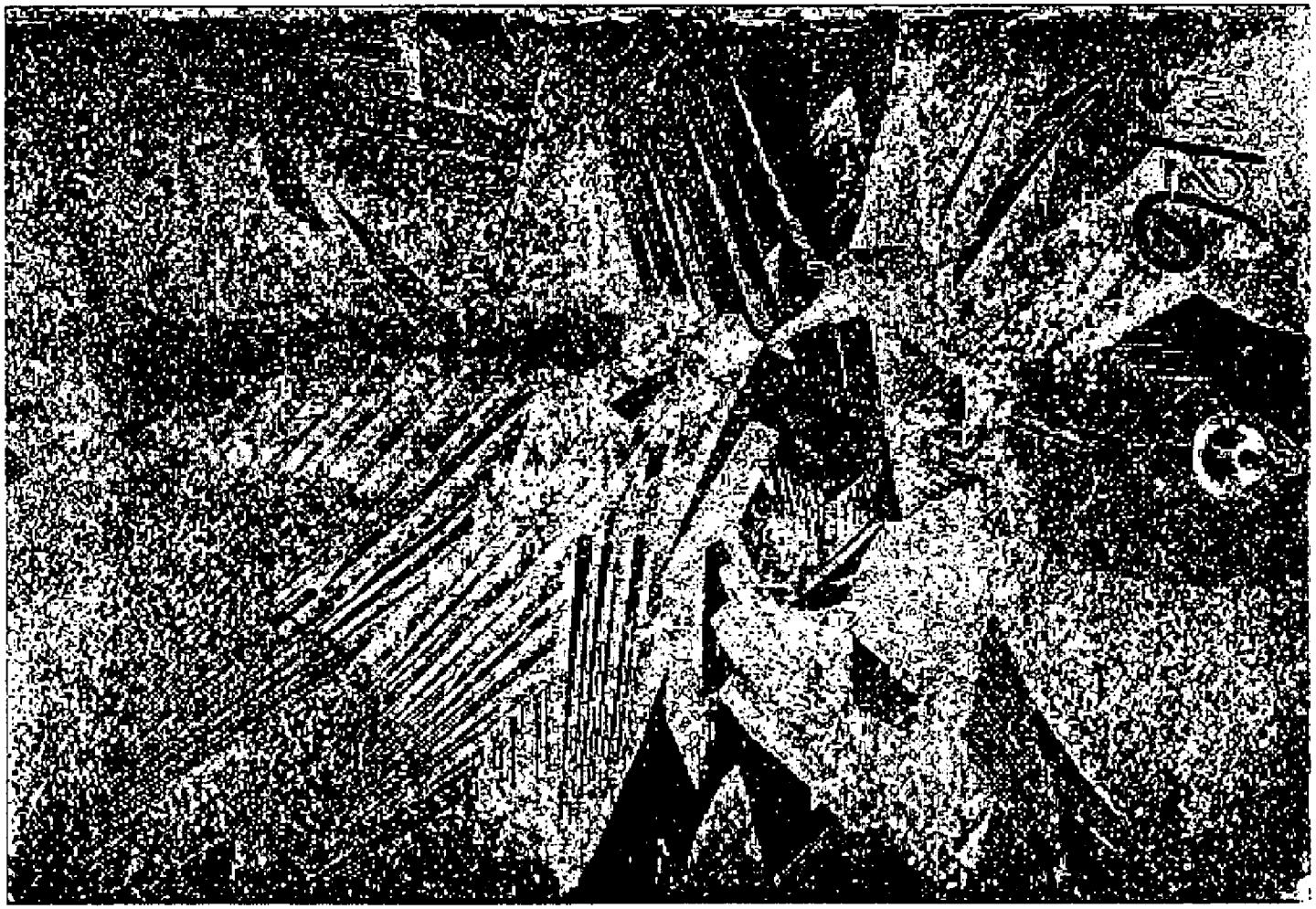
FIG. 7 is a photograph of a hot-dipped galvanized steel sample according to Test No. 16.

Steel samples were dipped in Zn+Pb baths with 30 ppm Al to which Sn and Bi were added in amounts of 0.1 Sn and 0.1 Bi, 0.5 Sn and 0.1 Bi, 0.8 Sn and 0.1 Bi and, 0.8 Sn and 0.2 Bi, respectively. As was the case with the Zn (SHG) Tests Nos. 9–13, the addition of 0.5 Sn+0.1 Bi was the preferred. composition that gave the galvanized coating the distinctive decorative appearance, as shown in FIG. 7.

Test No. 19

Figure 8:
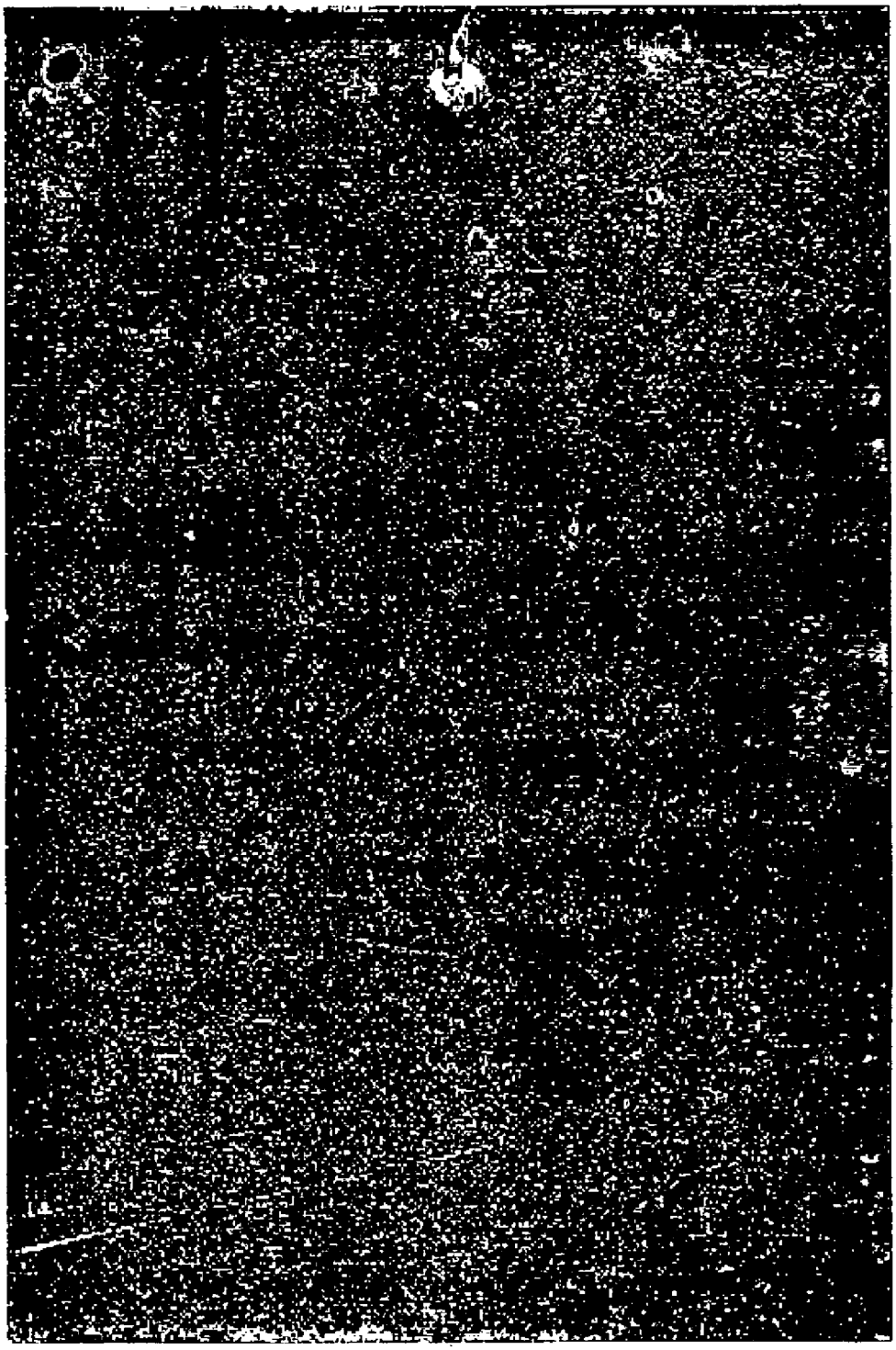
FIG. 8 is a photograph of a hot-dipped galvanized steel sample according to Test No. 19.

A steel sample was dipped in Zn (SHG) bath with 30 ppm Al addition and 0.5% Ni addition. The Ni addition did not produce a visible spangle in the coating, as shown in FIG. 8.

Test Nos. 20 and 21

Figure 9:
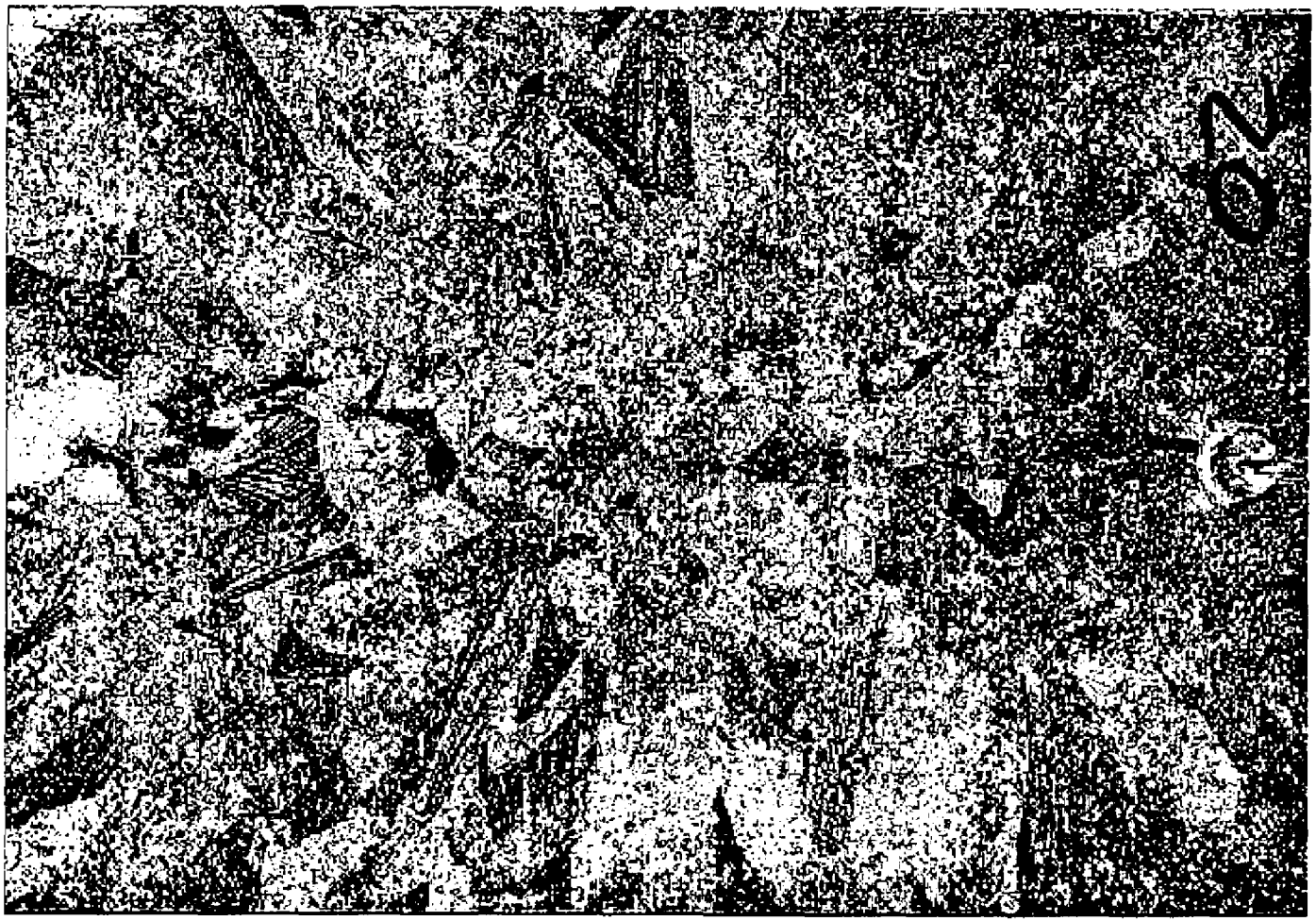
FIG. 9 is a photograph of a hot-dipped galvanized steel sample according to Test No. 20.

Steel samples were dipped in a Zn bath with 30 ppm Al and 0.05 Ni to which 0.5 Sn and 0.1 Bi were added in Test No. 20 , while in Test No. 21 0.5 Sn and 0.1 Bi were added to a bath containing 0.09% Ni. The Ni additions did not significantly alter the characteristic spangle obtained by the additions of Sn and Bi, as shown in FIG. 9 for Test Bath No. 20.

Test Nos. 22, 23 and 24

Figure 10:
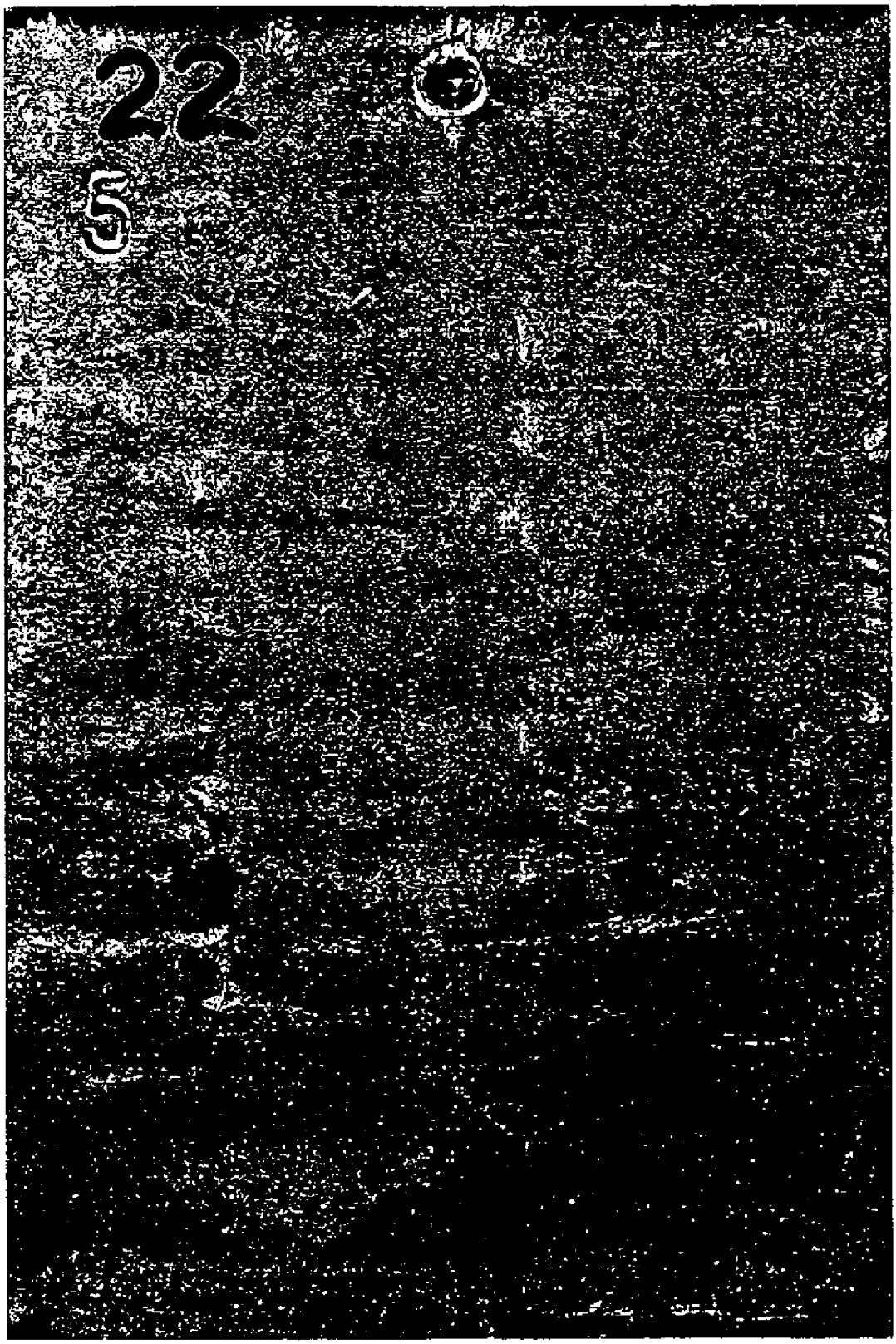
FIG. 10 is a photograph of a hot-dipped galvanized steel sample according to Test No. 22.
Figure 11:
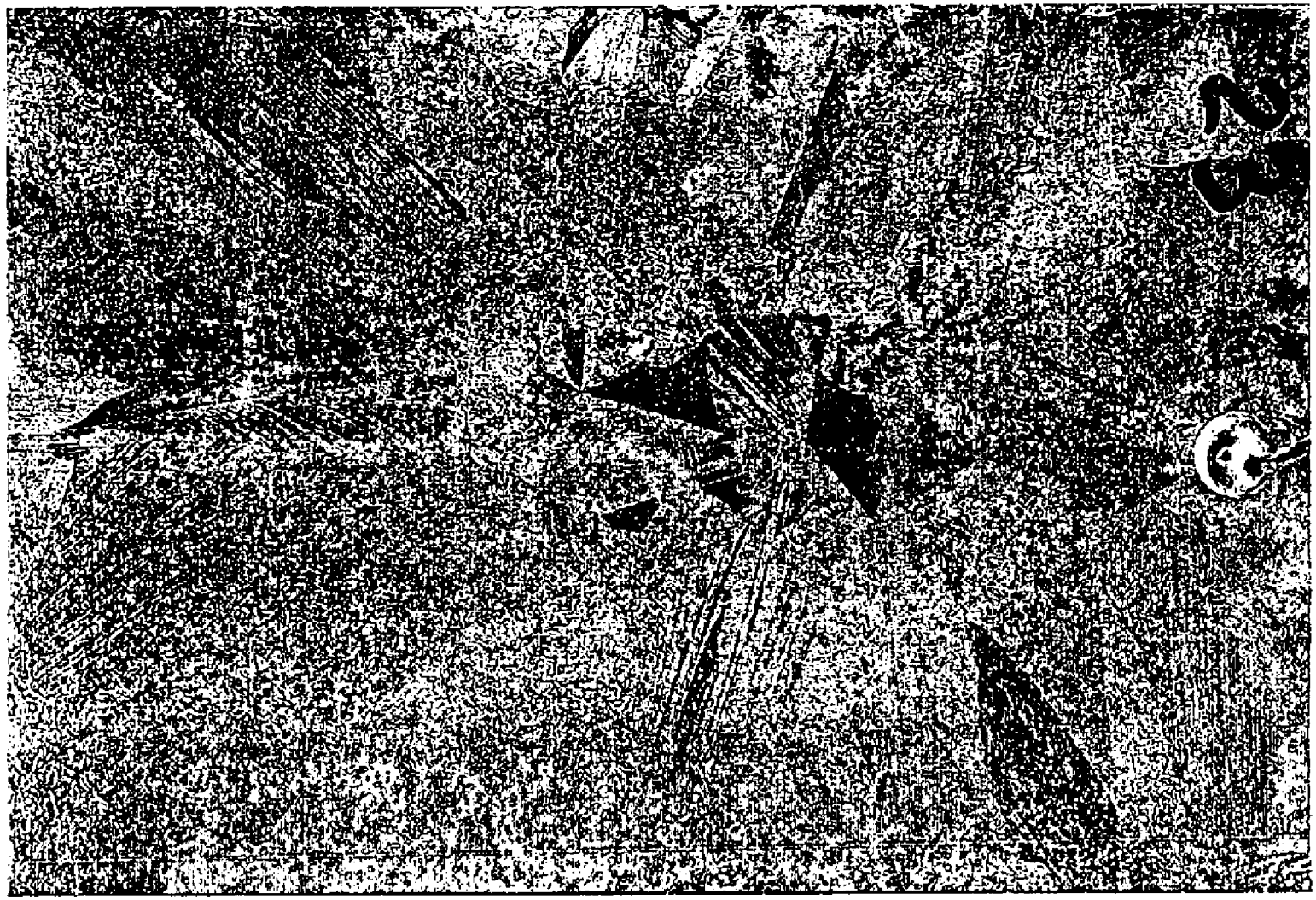
FIG. 11 is a photograph of a hot-dipped galvanized steel sample according to Test No. 23.

These tests were equivalent tests to Test Nos. 19, 20 and 21 but with Zn-Pb or PW zinc. the coating appearances were similar. FIG. 10 shows the coating appearance for Test No. 22 (zinc lead plus 0.5 wt % nickel), while FIG. 11 shows the coating appearance for Test No. 23 (after 0.5 Sn and 0.1 Bi were added to the bath composition of Test No. 22).

It will be understood, of course, that modifications can be made in the embodiments of the invention illustrated and described herein without departing from the scope and purview of the invention as defined by the appended claims.

What is claimed is:

1. An alloy for a galvanizing bath for providing a decorative spangle to non-reactive steel coated with said alloy consisting of 0.1 to less than 0.8 wt % tin, 0.05 to 0.15 wt % bismuth 0.001 to 0.008 wt % aluminum and 0 to 0.10 wt % nickel, the balance zinc of commercial purity.

2. An alloy for a galvanizing bath for providing a decorative spangle to non-reactive steel coated with said alloy as claimed in claim 1 consisting of about 0.5 wt % tin, about 0.1 wt % bismuth, about 0.003 to 0.005 wt % aluminum, the balance zinc of commercial purity.

3. A steel having a zinc alloy coating with a decorative spangle as claimed in claim 1.

4. A master alloy bar having effective amounts of tin, bismuth and aluminum, and optionally nickel, for introduction to a bath of molten zinc of commercial purity to provide an alloy as claimed in claim 1.

5. An alloy for a galvanizing bath for providing a decorative coating to mixed or moderately reactive steel containing up to 0.25 wt % silicon coated with said alloy consisting of 0.4 to less 0.8 wt % tin, 0.05 to 0.15 wt % bismuth, 0.001 to 0.005 wt % aluminum and 0.04 to 0.09 wt % nickel, the balance zinc of commercial purity.

6. An alloy for a galvanizing bath for providing a decorative coating to mixed or moderately reactive steel containing up to 0.25 wt % silicon coated with said alloy as claimed in claim 5 consisting of about 0.5 wt % tin, about 0.1 wt % bismuth, about 0.003 to 0.005 wt % aluminum and 0.04 to 0.06 wt % nickel, the balance zinc of commercial purity.

7. A mixed or moderately reactive steel containing up to 0.25 wt % silicon with a zinc alloy coating having a decorative spangle as claimed in claim 5.

8. A steel having a zinc alloy coating with a decorative spangle, said zinc alloy consisting of 0.1 to less than 0.8 wt % tin, 0.05 to 0.15 wt % bismuth, 0.001 to 0.008 wt % aluminum and 0 to 0.10 wt % nickel, the balance zinc of commercial purity.

9. A mixed or moderately reactive steel containing up to 0.25 wt % silicon having a zinc alloy coating with a decorative spangle, said zinc alloy consisting of 0.1 to less than 0.8 wt % tin, 0.05 to 0.15 wt % bismuth, 0.001 to 0.005 wt % aluminum and 0.04 to 0.09 wt % nickel, the balance zinc of commercial purity.

* * * * *